US006062111A

United States Patent [19]

Wershe

[11] Patent Number: 6,062,111

[45] Date of Patent: May 16, 2000

[54] MULTIPLE PURPOSE HAND TOOL FOR SPORTS EQUIPMENT

[76] Inventor: Richard Wershe, 28020 Elba, St. Slair Shores, Mich. 48081

[21] Appl. No.: 09/125,595

[22] PCT Filed: Feb. 21, 1997

[86] PCT No.: PCT/US97/02790

§ 371 Date: Aug. 21, 1998

§ 102(e) Date: Aug. 21, 1998

[87] PCT Pub. No.: WO97/30824

PCT Pub. Date: Aug. 28, 1997

Related U.S. Application Data

[60] Provisional application No. 60/012,024, Feb. 21, 1996.

[51] Int. Cl.[7] ..... B25B 23/16

[52] U.S. Cl. ..... 81/177.4; 81/438; 81/177.2; 81/490

[58] Field of Search ..... 81/438, 439, 177.4, 81/490, 177.1, 177.2, 489; 7/138, 165, 167, 170

[56] References Cited

U.S. PATENT DOCUMENTS

| | | |
|---|---|---|
| D. 197,915 | 4/1964 | Ayars . |
| 3,742,533 | 7/1973 | Brunette . |
| 4,384,499 | 5/1983 | Shockley . |
| 4,399,723 | 8/1983 | Marleau . |
| 4,467,677 | 8/1984 | Grifford . |
| 4,774,736 | 10/1988 | Brawner et al. . |
| 4,848,197 | 7/1989 | Kikel . |
| 5,018,411 | 5/1991 | La Padura . |
| 5,320,004 | 6/1994 | Hsiao . |
| 5,365,811 | 11/1994 | Chi . |
| 5,442,982 | 8/1995 | Bell . |
| 5,495,630 | 3/1996 | Estein et al. . |
| 5,515,249 | 5/1996 | Shiao . |
| 5,526,723 | 6/1996 | Sormunen et al. . |
| 5,544,379 | 8/1996 | Chen . |
| 5,588,169 | 12/1996 | Chuang . |
| 5,592,859 | 1/1997 | Johnson et al. . |

FOREIGN PATENT DOCUMENTS

| | | |
|---|---|---|
| 3744176A1 | 12/1987 | Germany . |
| WO89/03282 | 4/1989 | WIPO . |

OTHER PUBLICATIONS

C. W. Woodson, "Machining Cylinder," *Popular Science,* (May 1947), pp. 191–192.

*Primary Examiner*—David A. Scherbel
*Assistant Examiner*—Joni B. Danganan
*Attorney, Agent, or Firm*—Reising, Ethington, Barnes, Kisselle, et al.

[57] ABSTRACT

A portable tool assembly (10) has a flat carrying case (12). The case has a groove along an edge side (26) to snap-fit an allen wrench (18) in place and an opposite edge side (24) to snap-fit tool bits (14 and 16) in place. Counterbores (22) function to nonrotatably seat the tool bits in a usable position such that the case (12) acts as a handle for the tool bit. A key ring loop (20) extends from another edge side.

15 Claims, 9 Drawing Sheets

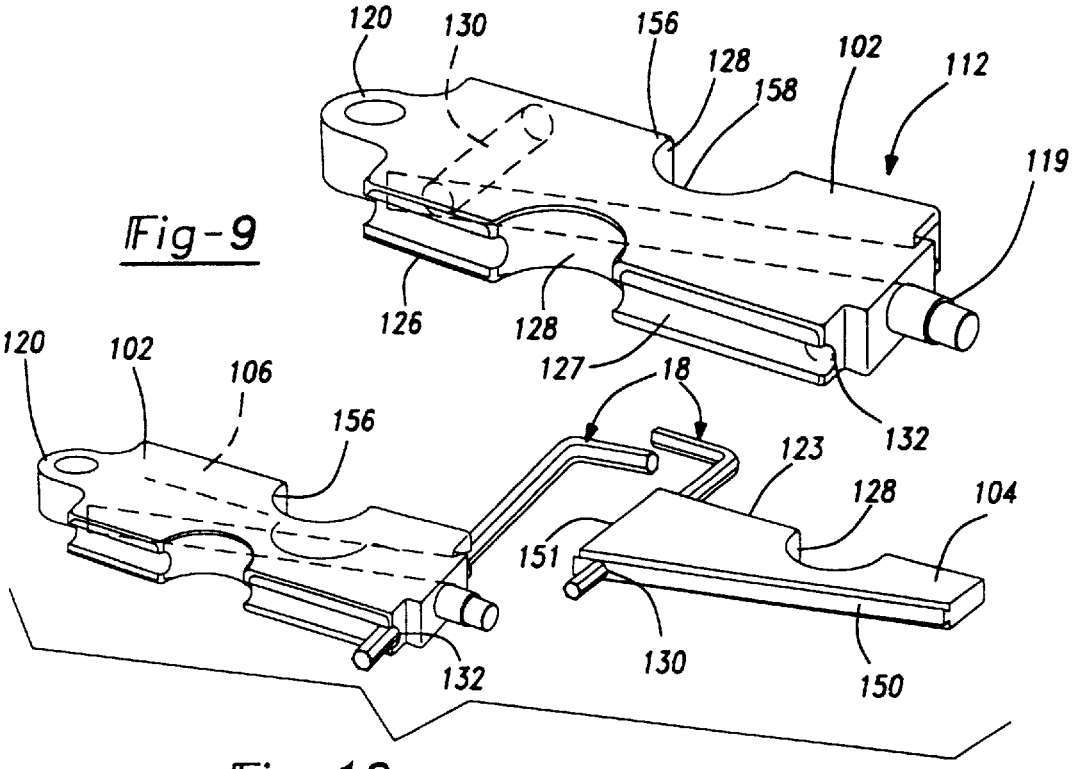
Fig-9
Fig-10
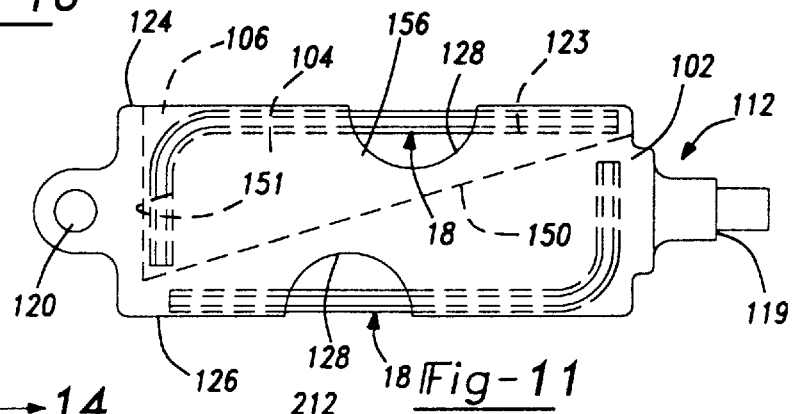
Fig-11
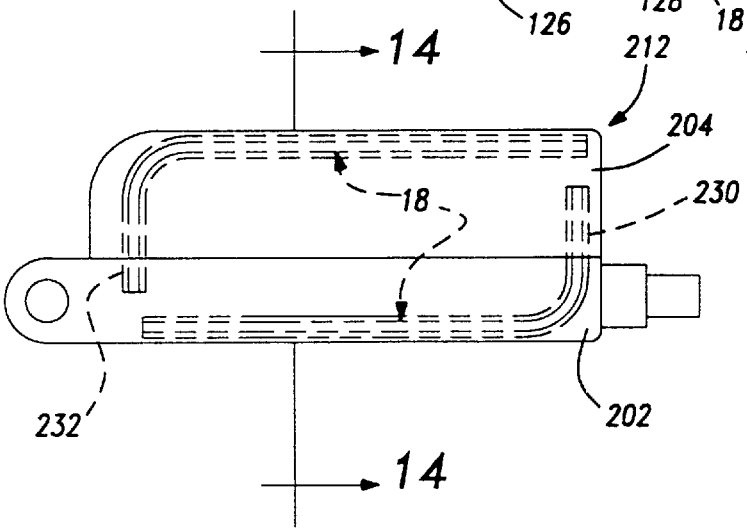
Fig-12

Fig-13
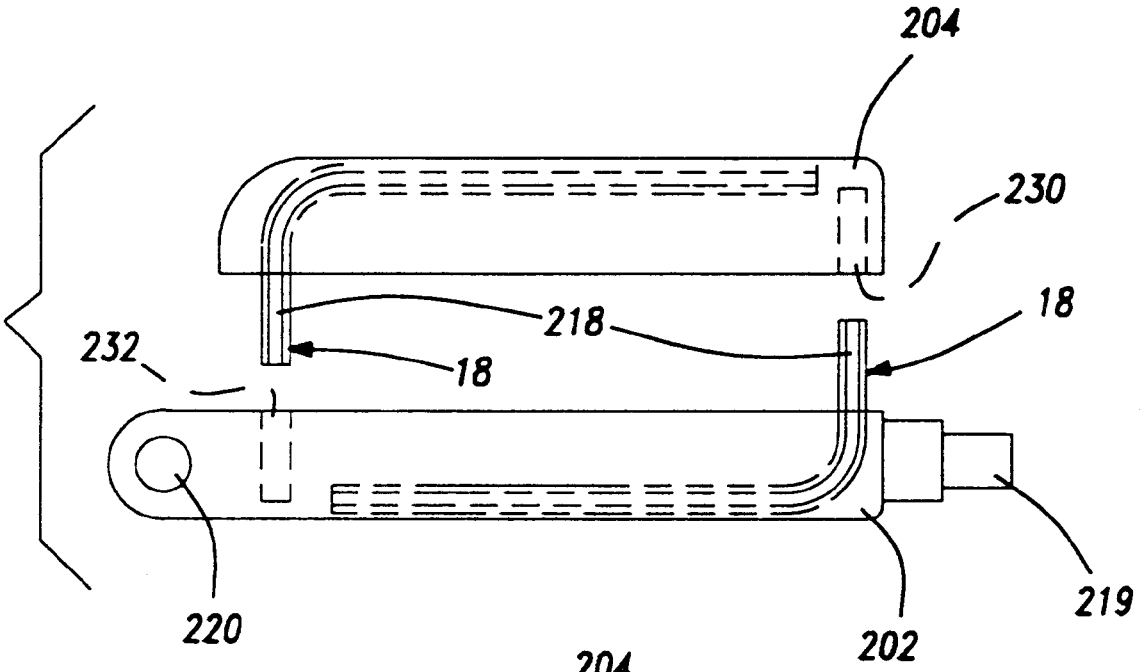
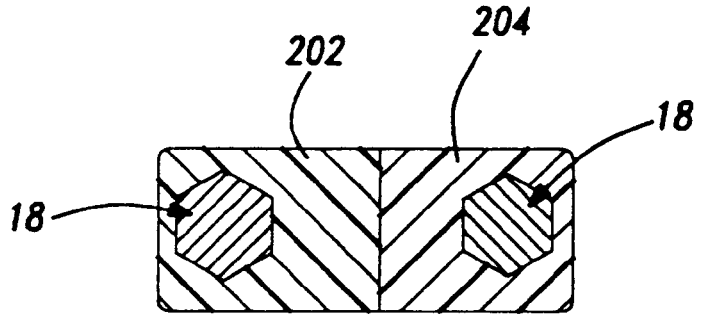
Fig-14
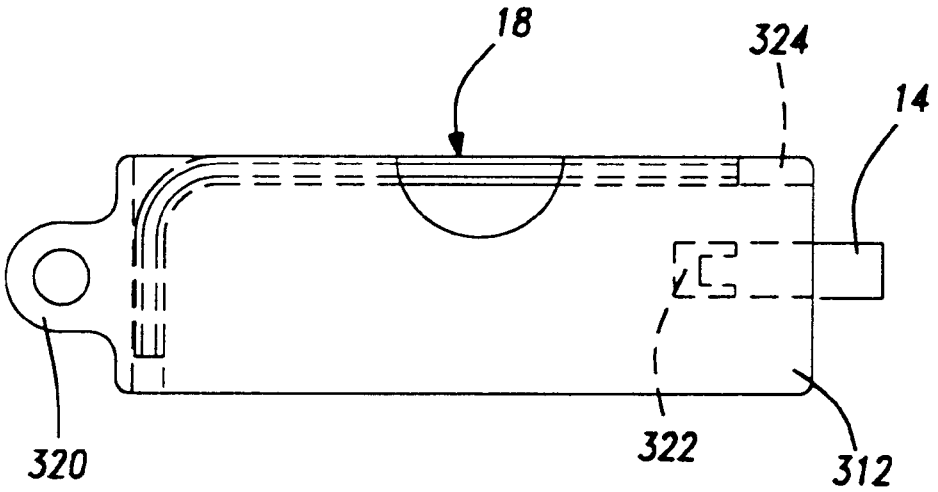
Fig-15

MULTIPLE PURPOSE HAND TOOL FOR SPORTS EQUIPMENT

This application claims benefit of provisional appln. No. 60/012,024, Feb. 21, 1996.

This application is a 371 of PCT/US97/02790 Feb. 21, 1997.

TECHNICAL FIELD

The field of this invention relates to a pocket tool that is easily portable but provides for the necessary tool bits for repairing portable sports equipment such as in-line skate wheels, bearings, and archery equipment.

BACKGROUND OF THE DISCLOSURE

Outdoor individual sports have enjoyed an increase in popularity. Many of these sports require portable equipment such as archery bows or in-line skates that may need maintenance or repair on the spot. A tool is often necessary for properly maintaining or repairing the equipment.

One such sport that has enjoyed a surge in popularity is in-line skating. Adults have joined youth in popularizing this sport. In-line skates include a plurality of wheels, such as four or five, that are attached under a shoe or boot along the center-line. The wheels have a rounded outer surface to provide a wide variation of camber with respect to the floor or skating surface. This wide camber variation provides the sharp turns and push off capability for quick accelerations of the skater. Each wheel has it own axis of rotation with a race of bearings about the inside and outside ends of a fixed axle hub section.

Due to the small diameter of the wheel, the wheel undergoes high revolutions per minute and a lot of wear and tear is encountered by the bearings. Furthermore, the skate encounters tremendous stresses such as pot holes, curbs, and harsh landings at the end of jumps. The wheels and bearing races periodically need to be repaired or otherwise adjusted.

What is needed is a convenient portable tool that can be used loosen and tighten the axle pins and to push the bearings and axle sheath out of the wheel in order repair or adjust the wheels and bearings. What is also needed is a tool that can be used as a lace puller. What is generally needed is a portable pocket tool that can have multiple uses for repairing and maintaining sports equipment.

SUMMARY OF THE DISCLOSURE

In accordance with the invention, a portable tool assembly includes a carrying and storage case and a plurality tool bits such as screw driver bits, hex keys commonly called allen wrenches or other elongated tool. The tool bits are stored in recesses in the storage case. The elongated tool such as an allen wrench is stored along an edge of casing and desirably within an appropriately sized groove in the respective edge such that a friction press fit or snap fit is formed with the tool element. For the snap fit, the groove may have a lip or protrusion to form the snap fit with the respective tool element. The press fit or snap fit is sufficiently strong to keep the tools in place against accidental jarring but allows a person to manually remove each tool element. Each edge has a semi circular or other shaped recess for allowing access to each tool element.

The case is made from a rigid plastic such as polycarbonate or metal or other structurally appropriate material. The case has a key ring loop at one end edge side thereof. The opposite edge side has a counter bore that is sized to snugly and partially receive tool bits in an operating position to allow the case to function as a screw drive handle or as a handle for the bearing pusher or other housed tool. The casing has two major sides that are substantially flat or planar in nature. However other contours of the major sides are possible such as to form with the internal contour of a gripping hand.

The casing also has apertures therethrough to receive the elongated tool such as a drive bit or allen wrench such that the casing can function as a handle for the respective tool wrench.

The allen wrench or other elongated tool is totally separable from the casing such that one bit when placed in an appropriate aperture functions as one tool while the elongated tool such as the allen wrench can function as a second tool simultaneously with use of one of the bit tools. This use of one of the bits simultaneously with the elongated tool is important for example when the axle of the wheel needs to be loosened or removed from the wheel.

It may be also desirable to have the casing split apart to provide a casing portion for each tool that is used simultaneously. The casing can be formed from an outer section and a slidable insert section that fits within a hollow complementary shaped recess within the outer section. The casing may store two allen wrenches. In this fashion, both allen wrenches can be used simultaneously with respective casing sections forming handles.

In another aspect of the invention, a first and second allen wrench can be partially embedded into a respective section of the casing with an operating tip exposed from each section of the casing. The casing sections can be separated from each other in the stored position to the operating separated position.

In this fashion, a convenient portable tool can accompany a person such as a skater and be used to repair and fix the sports equipment such as the wheel and axle of an in-line skate when needed.

BRIEF DESCRIPTION OF THE DRAWINGS

Reference now is made to the accompanying drawings in which:

FIG. 9 is a top perspective view of another embodiment of a tool casing;

FIG. 10 is an exploded view of the casing and tool bits shown in the operating position;

FIG. 11 is a top elevational view of the casing shown in FIG. 9 with the tools shown in the stored position;

FIG. 12 is a top elevational view of a third embodiment of a tool casing shown in the stored position;

FIG. 13 is an exploded view of the tool casing with the tool bits exposed in the operating position;

FIG. 14 is a cross-sectional view taken along lines 14—14 shown in FIG. 12;

FIG. 15 is a top elevational view of a fourth embodiment of a tool casing shown in the stored position;

FIG. 16(*a*) illustrates the tool case as shown in FIG. 16 with a bearing puller and philips screw head bits;

DETAILED DESCRIPTION OF THE PREFERRED EMBODIMENT

Figure 1:
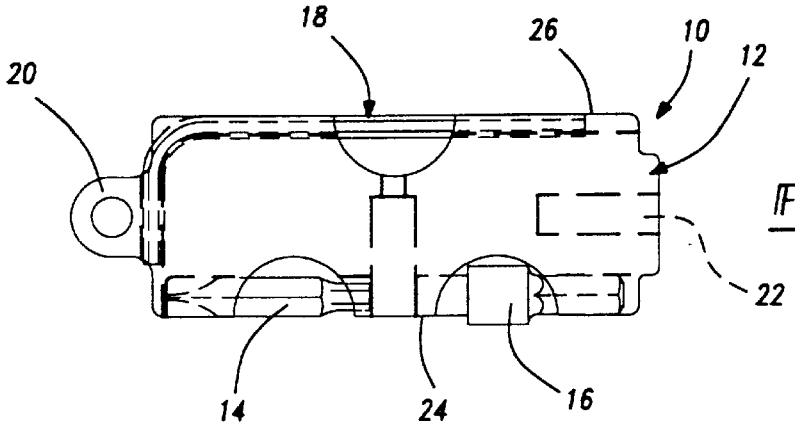
FIG. 1 is a top elevational view of one embodiment of a portable tool in accordance with the invention with tool bits in the stored position.
Figure 2:
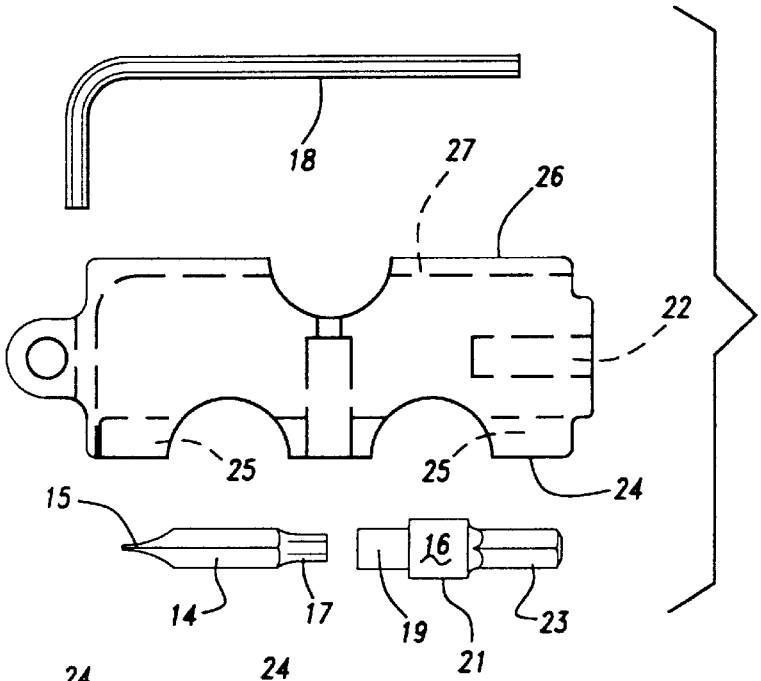
FIG. 2 is an exploded view of the tool shown in FIG. 1.
Figure 3:
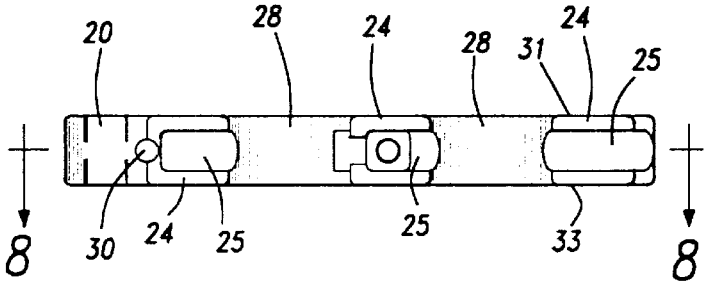
FIG. 3 is a side elevational view of the tool casing shown in FIG. 2.
Figure 4:
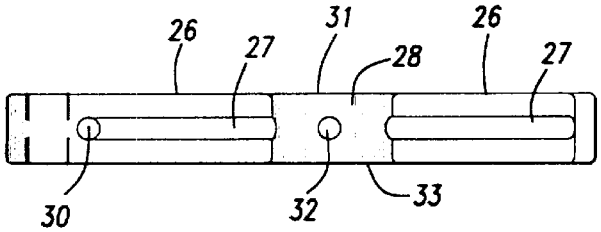
FIG. 4 is an opposite side elevational view of the tool casing shown in FIG. 3.

Referring now to FIGS. 1 and 2, a portable tool assembly 10 includes a carrying and storage case 12, tool bits 14 and 16 and a hex key referred hereinafter as an allen wrench 18. The tool bit 14 has one end shaped as a screw driver blade 15 and an opposite end shaped as a hex bit of the same diameter size as allen wrench 18. Bit 16 has one end 19 sized to be a bearing and axle pusher 19 with an enlarged mid section 21 and mounting end section 23.

Figure 5:
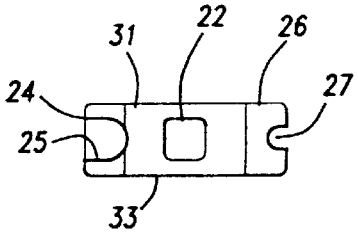
FIG. 5 is an end view of the tool casing shown in FIG. 3.
Figure 6:
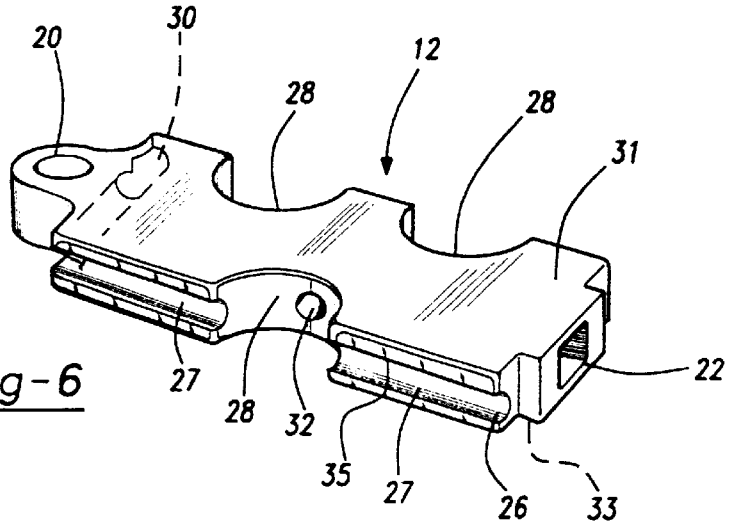
FIG. 6 is a perspective view of the casing shown with the tool bits removed.

The tool bits 14 and 16 are stored along an edge side 24 of case 12. The allen wrench is stored along the edge side 26 of casing 12. Each edge side 24 and 26 as shown clearly in FIG. 5 has an appropriately sized grooves 25 and 27 to receive the tools bits 14 and 16 and allen wrench 18 respectively. The grooves are sized to provide a snap fit of the tool bits 14 and 16 and allen wrench respectively. The snap fit is achieved by a lip 35 along the outer edge of the groove tong to keep the tools in place against accidental jarring but allows a person to manually remove each piece 14, 16 and 18. Each edge 24 and 26 has a semi circular recess 28 for allowing access to each tool bit 14 and 16 and wrench 18 respectively. The recess 28 is sized to partially receive the fingers or thumb of an operator to facilitate grabbing of the case as a handle as described in more detail below.

Figure 7:
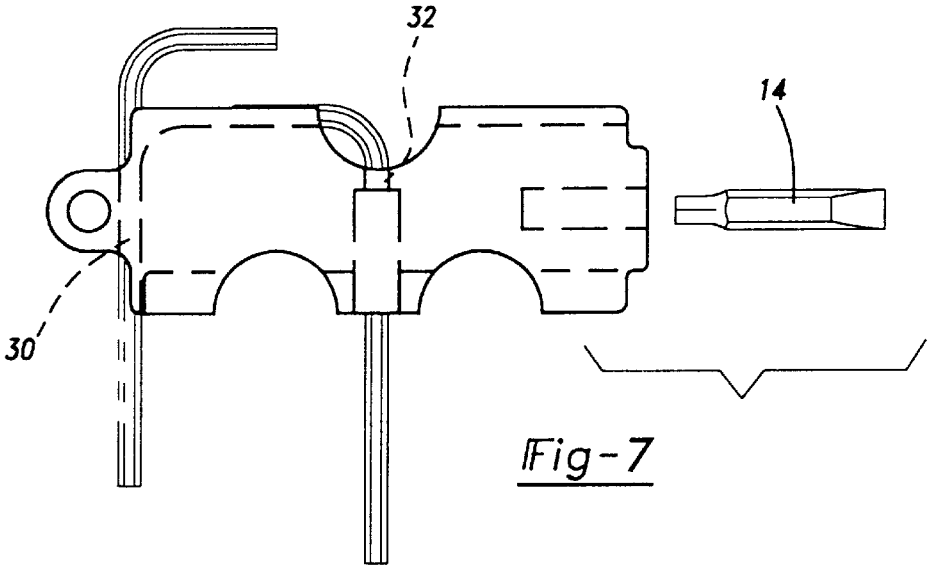
FIG. 7 is a top plan view showing an example of the tools positioned for use.

The case 12 is made from a rigid plastic such a polycarbonate or metal. The case has a key ring loop 20 at one end thereof. The opposite end has a counter bore 22 that is sized to snugly and partially receive the bits 14 and 16 in an operating position as schematically illustrated in FIG. 7 to allow the case to function as a screw driver handle as shown or as a handle for the bearing pusher. The casing has major sides 31 and 33 being substantially flat or planar in nature.

The casing also has a side aperture 30 and central aperture 32 as shown which are sized to non rotatably receive the allen wrench 18 such that the casing can function as a handle for the allen wrench 18 as illustrated in FIG. 7.

Figure 8:
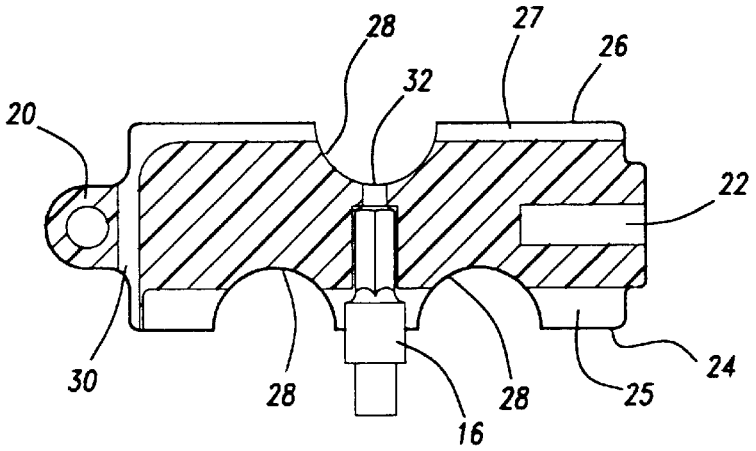
FIG. 8 is a cross-sectional view taken along FIG. 8—8 shown in FIG. 3.

In addition, the center aperture 32 can also receive the bits 14 and 16 as illustrated in FIG. 8.

The wrench 18 is totally separable from the casing such that one bit when placed in aperture 32 or counter bore 22 to function as one tool, the allen wrench 18 can function as a second tool simultaneously with use of one of the bit tools 14 or 16. This use of one of the bits 14 or 16 simultaneously with wrench 18 is important for example when the axle of the wheel needs to be loosened or removed from the wheel. The pin axle and axle fastener are typically constructed to have allen wrench receiving sockets in their respective opposite facing heads. The bit is used to engage one end of the axle and the wrench is applied to the second end and torque is applied by both tools to loosen the axle.

It may be also desirable to provide a casing portion for each tool that is used simultaneously. The embodiment shown in FIGS. 9–11 shows such an option. In this embodiment, the casing 112, is formed from an outer section 102 and a slidable insert section 104 that fits within a hollow complementary shaped recess 106 within section 102. Insert 104 has a semi circular recess 128 at edge 123. An aperture 130 extends transversely through the insert 104 from edge 123 to angled edge 150 in proximity to the wider end 151. The aperture 130 is sized to non rotatably receive allen wrench 18 such that the section 104 can act as a handle for the wrench 18. Again the recesses in each case section facilitates grabbing with the fingers and thumb of the respective hands of the operator.

Handle section 102 has an edge 126 with a groove 127 to store a second allen wrench 18. The edge 126 also has a recess 128 to allow access to the wrench as shown in FIG. 11. An aperture 132 passes transversely through the section 102 from the edge 126 to an opposite edge 124. The aperture 132 is also sized to non-rotatably receive the second wrench 18 such that the section 102 can act as a handle for the second allen wrench 18.

As shown in FIG. 10 both allen wrenches 18 can be used simultaneously used with respective handles. When the tools are not in use the section 104 can be positioned within the complementarily shaped recess 106 within section 102. One allen wrench 18 is placed in the space between two walls 156 and 158 of section 102 and about insert 104. The second allen wrench 18 is placed in the aperture 132 and along groove 128. As with the first embodiment, the grooves and walls are sized and positioned to provide a friction press fit to maintain storage position of the removable allen wrenches 18.

The casing section 102 also has a key ring loop 120 and a built in bearing pusher 119 at an opposite end.

A third embodiment is shown in FIGS. 12, 13, and 14. Each allen wrench 18 is partially embedded into a respective section 202 and 204 with an operating tip 218 exposed as shown in FIG. 13. Each case section 202 and 204 has respective apertures 230 and 232 sized to snugly receive a respective operating tip 218 to form a full portable case 212 as shown in FIG. 12. The section 202 has a key ring loop section 220 and a built in bearing pusher 219. Each case section 202 and 204 may be molded about a respective wrench with the wrench section completely embedded in the plastic material of the respective case section as shown FIG. 14.

The embodiment shown in FIG. 15 has an allen wrench 18 mounted on an edge 324 which can be stored and placed in an operating position with respect to case 312 or used separately in much the same fashion as previously discussed for the first embodiment. The case 312 has a counter bore 322 at one end to reversibly fit a tool bit 14. The other end has a key ring loop 320.

Reference now is made to FIGS. 16–19 that show a case 12 similar to the first embodiment with several optional features. The major side 31 has a recess 40 which seats a pin 42 that can be used to open the bearing race. Another hexagonal recess 44 is also in major side 31 and is properly sized to non-rotatably receive a nut head commonly found in use with in-line skates.

The ring loop 20 has a differently sized hexagonal aperture 46 that can also receive a differently sized nut head commonly found in use with in-line skates.

Figure 19:
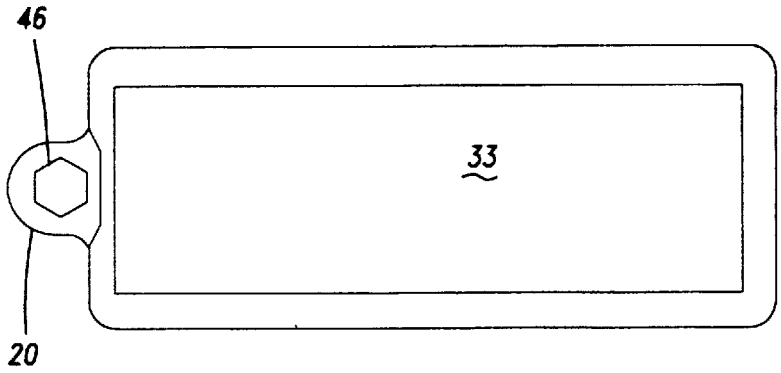
FIG. 19 is a bottom elevational view of the casing shown in FIG. 18.

Edge side 24 has a smaller sized groove 50 under groove 25 to receive a second smaller allen wrench 48 under wrench 18. The recess 28 is only in major side 31 such that major side 33 as shown in FIG. 19 remains substantially rectangular in shape.

Figure 16:
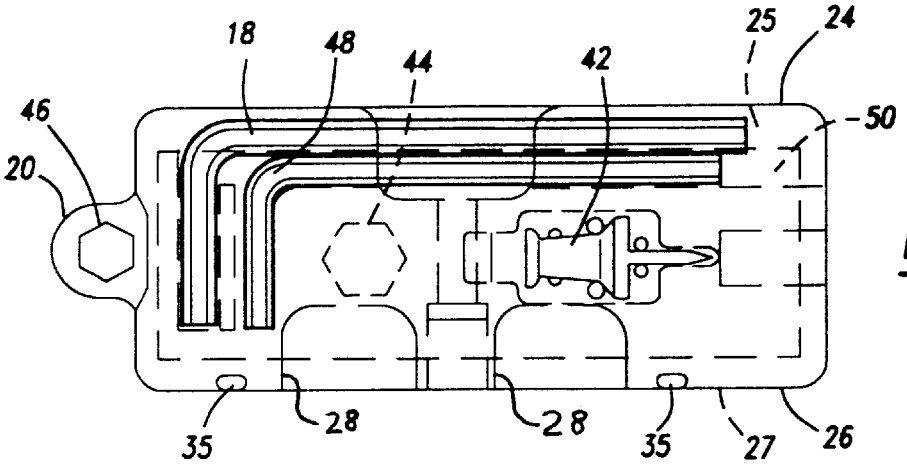
FIG. 16 is a top elevational and schematic view of another embodiment that stores two differently sized allens wrenches.
Figure 16A:
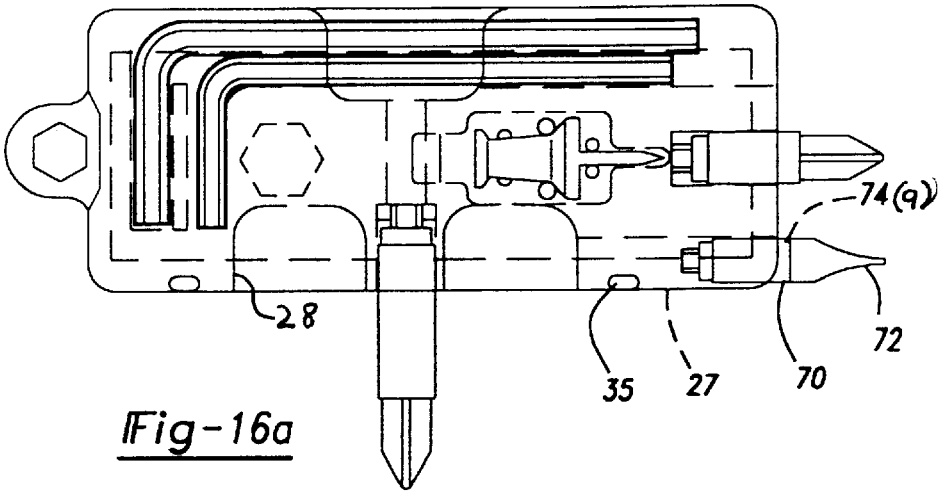
Figure 17:
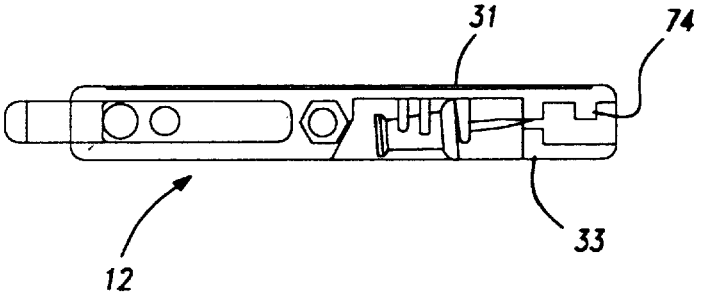
FIG. 17 is a side elevational view of the embodiment shown in FIG. 16.
Figure 18:
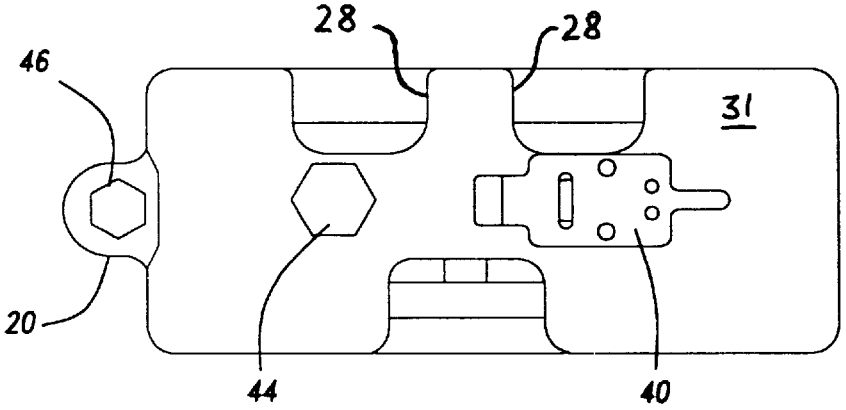
FIG. 18 is a top elevational view of the casing shown in FIG. 16.

FIG. 16(*a*) discloses the bits in the usable positions. The bearing puller 70 has a distal hook end 72 as more clearly shown in FIG. 27. The puller 70 is fitted into groove side edge 26. The puller has a notch 74 which receives a protrusion 74 extending from the casing within groove 27 as more clearly shown in FIG. 17 to lock the puller in place.

Figure 20:
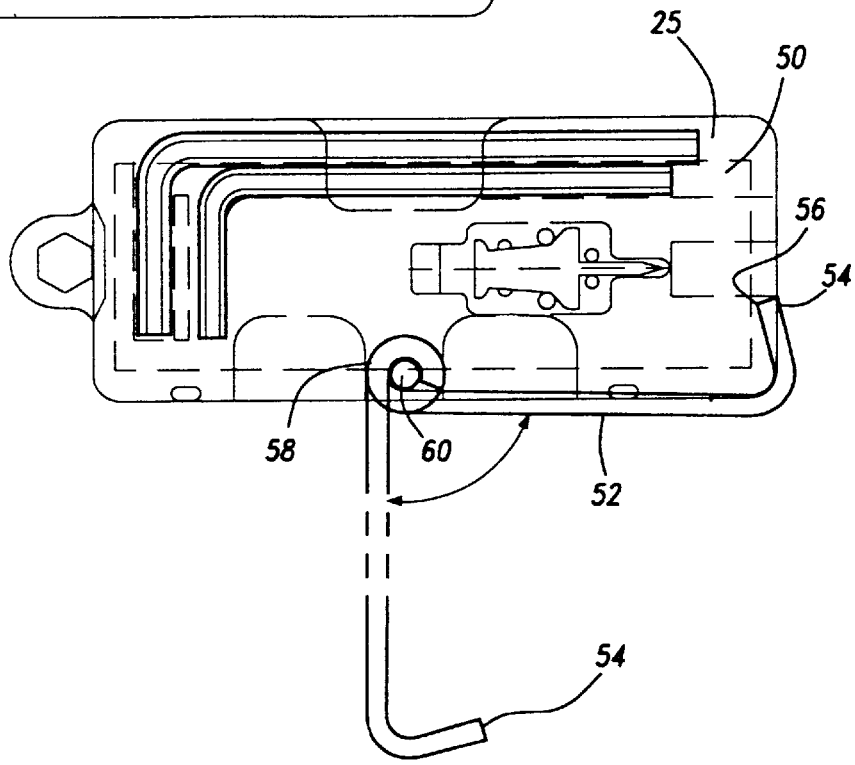
FIG. 20 is a view similar to FIG. 16 with an optional lace puller added to the tool case.

FIG. 20 illustrates an optional lace puller 52 movable between a closed position where tip 54 hooks into the case at point 56 and a usable position where distal end 54 is free to pull and tighten laces of in-line skates. The loop end is pivotable to a boss 60 on case 12.

Figure 21:
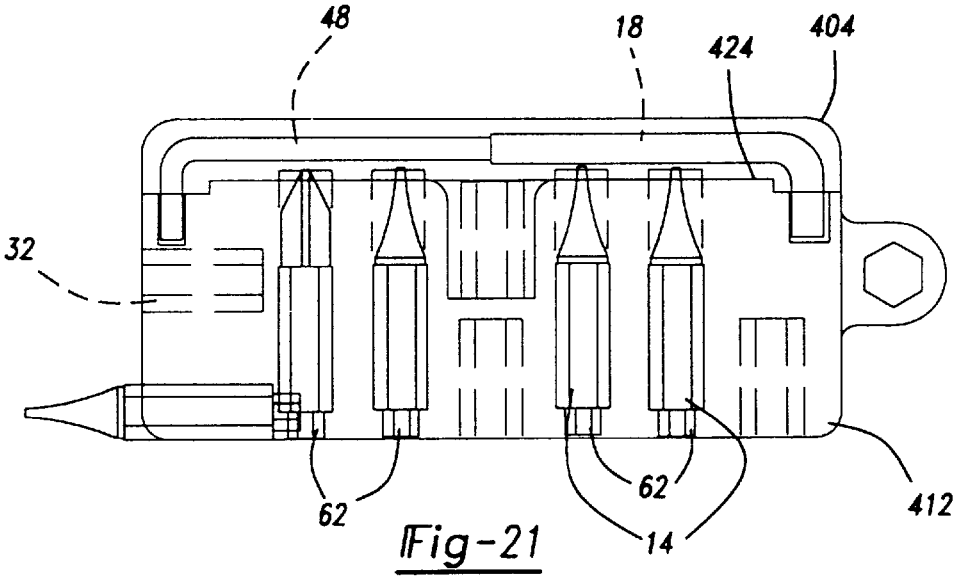
FIG. 21 is a top elevational view of another embodiment.
Figure 22:
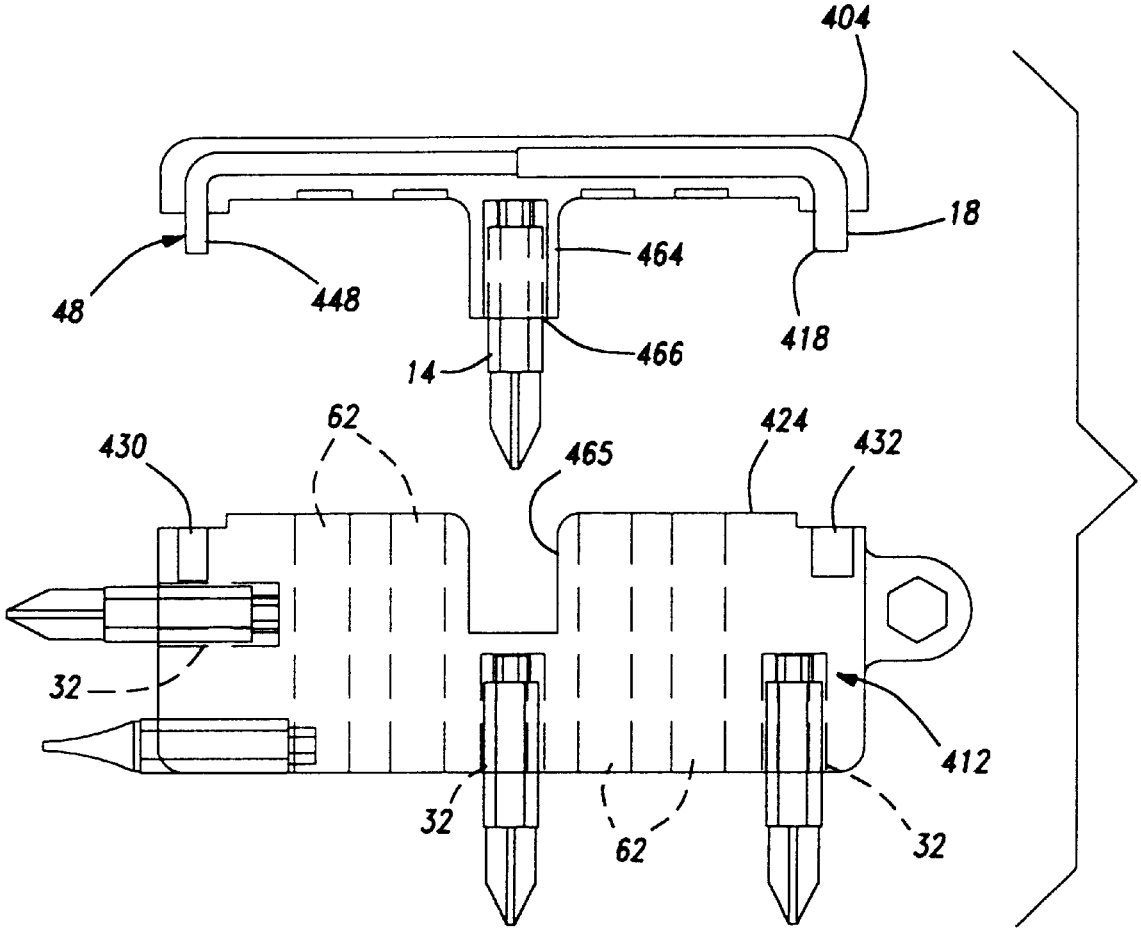
FIG. 22 is an exploded view of the embodiment shown in FIG. 21.
Figure 23:
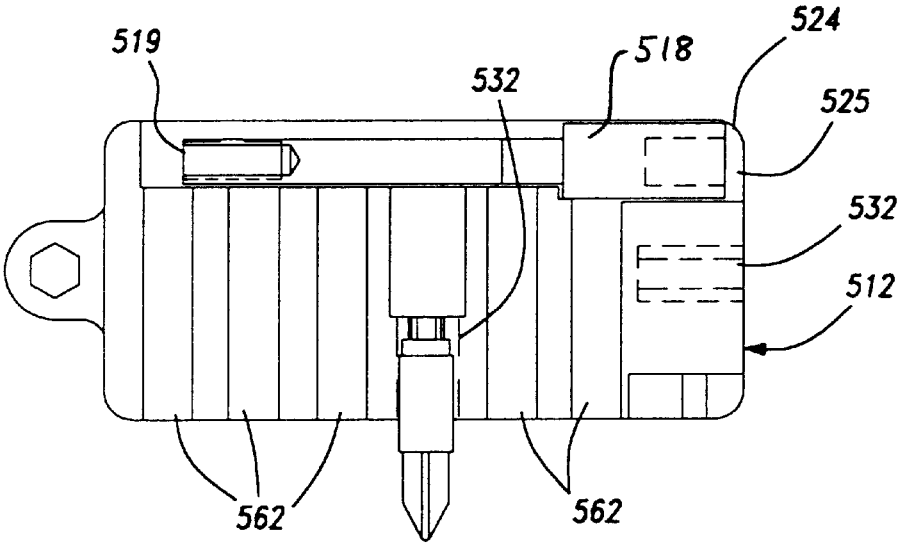
FIG. 23 is a top elevational view of another embodiment.

FIGS. 21 and 22 illustrate a case 412 that stores the bits in recesses 62 that are vertical with respect to the edge side 424 that seats the allen wrench 18. The first allen wrench 18 and smaller allen wrench 48 are substantially embedded in plastic that forms a handle 404. Each wrench has its bit 418 and 448 extending out of the handle 404 to be received in apertures 430 and 432 in the case 412. The center leg 464 has a tool receiving recess 466 to hold a bit 14. Other bits 16 can be usably mounted in counter bores 32 as in the first described embodiment. When the handle is in the stored position, the center leg 464 is received in notch 465 in the casing as shown in FIG. 21.

FIGS. 23–26 disclose a tool case 512 with tools that are useful with archery equipment. Along one side edge 524, a groove 525 seats an elongated driver 518 that has a threaded tap end 519 that can be used with arrow shafts. The case 512 has recesses 562 vertically positioned with respect to the groove 525 to store tool bits. As with previously mentioned embodiments, the tool case can also seat a puller 70 at the edge side of the case.

Figure 24:
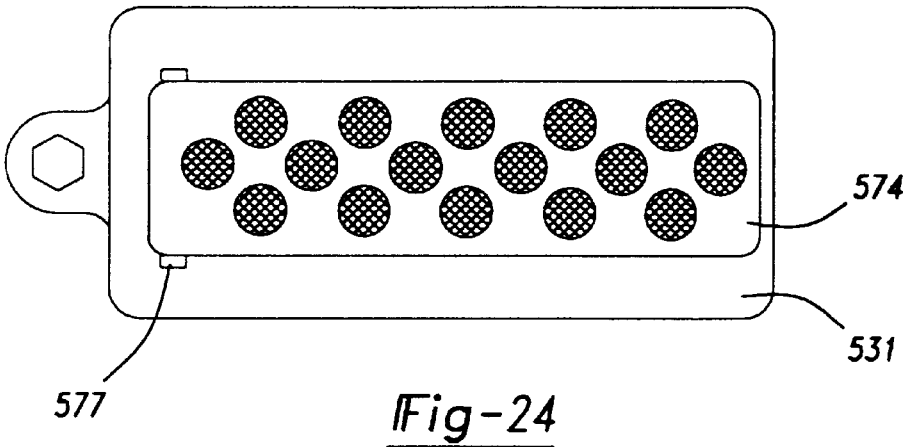
FIG. 24 is a side elevational of an edge side of the embodiment shown in FIG. 23.
Figure 25:
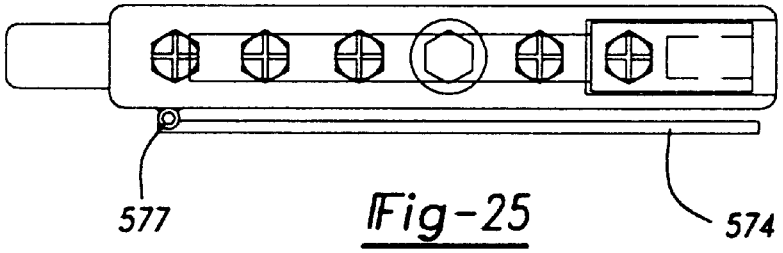
FIG. 25 is a bottom elevational view illustrating a file pivotably attached to the bottom major side.

The case also has counter bores 532 in the edge sides of the case. As shown in FIGS. 24 and 25, the major side 531 has a file 574 pivotably mounted thereon at pivot 577 with the case used as a handle for the file.

Figure 26:
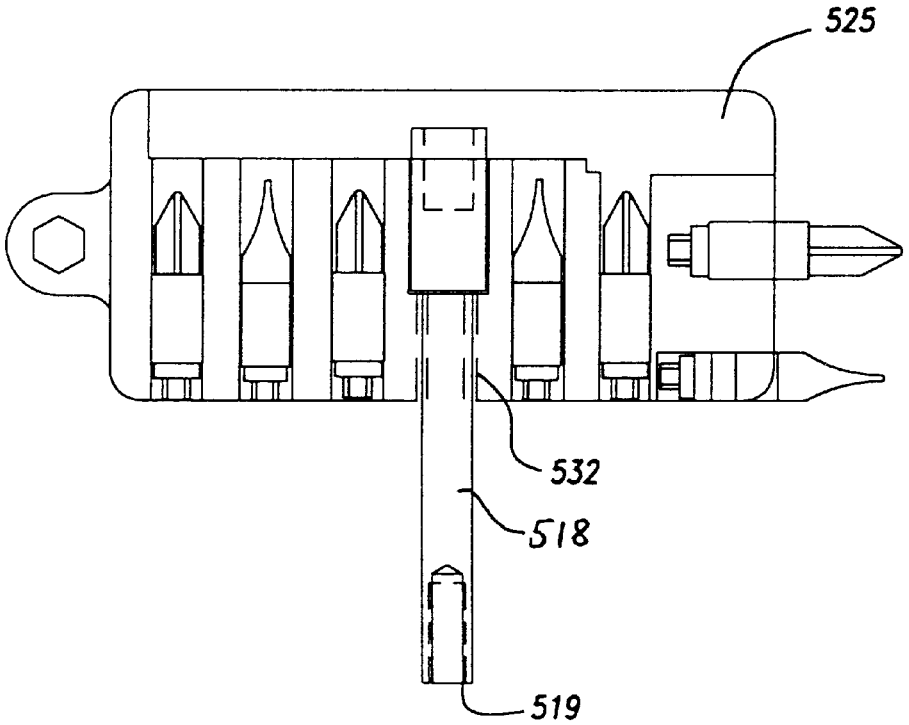
FIG. 26 is a view similar to FIG. 23 with the tools shown stored and the elongated driver positioned for usage.

As shown in FIG. 26, the elongated tool or driver 518 can be inserted through the counter bore 532 such that the case 512 functions as a handle for the driver 518.

Figure 27:
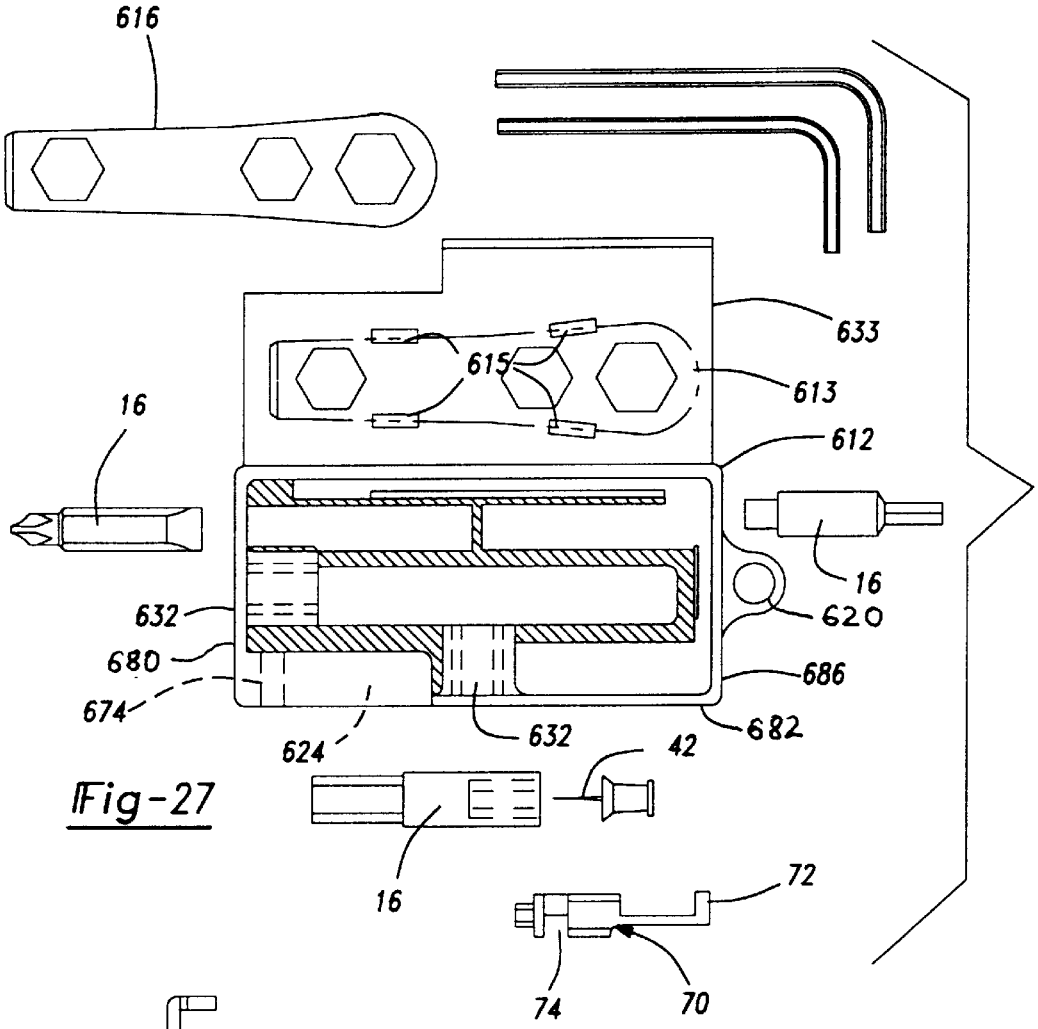
FIG. 27 is an exploded top elevational view of embodiment that incorporates a flip cover.
Figure 28:
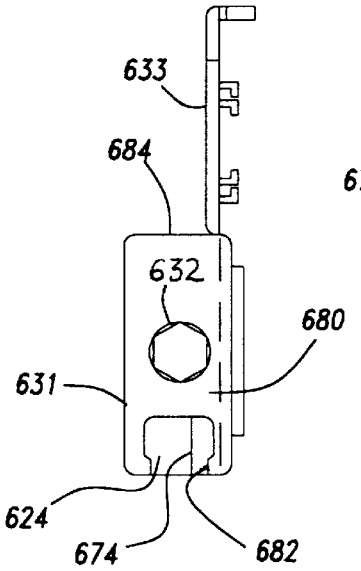
FIG. 28 is a side elevational view of the case shown in FIG. 27.
Figure 29:
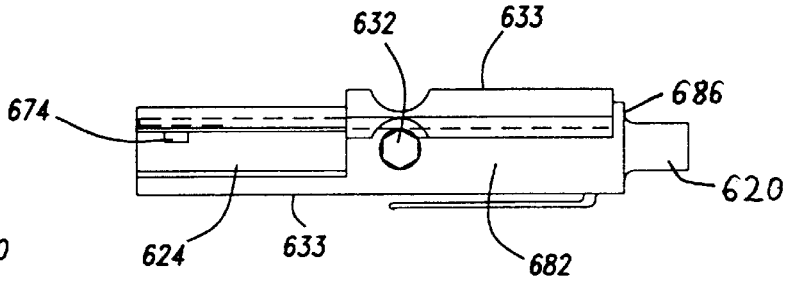
FIG. 29 is another side elevational view with the cover in the closed position.

Another embodiment is disclosed in FIGS. 27–29. In this embodiment the case 612 has a flip cover 613. The cover has prongs 615 that snap fits a spanner wrench 616. The tool bits 16 can be mounted within the main section 622 of the case 612. The case 612 is shaped to have two major sides 631 and 633 and four edge sides 680, 682, 684 and 686 with counter bore 632 extending through edge sides 680 and 682 to nonrotably receive the tools in a usable position. The key ring loop 620 protrudes from the edge side 686. Furthermore edge side 682 has a groove 624 with protrusion 674 therein to receive puller 70.

In this fashion, a convenient portable tool can accompany a skater or archer and be used to repair and fix the wheel and axle or a bow and arrow when needed.

Variations and modifications are possible without departing from the scope and spirit of the present invention.

What is claimed is:

1. A multiple bit hand tool comprising:

a carrying case having two spaced apart major sides with edge sides therebetween;

a first of said edge sides having a seat for storing an elongated tool therealong;

a first elongated tool sized to be seated to and along said first edge side without extending beyond confines of said carrying case;

a plurality of recesses in a second edge side between said major sides for receiving and storing a plurality of screw driver bits and a bearing pusher bit therein without extending out from said carrying case;

a counter bore in said case through said second edge side between said major sides for non-rotatably receiving a selected one of said plurality of screw driver bits such that when said selected driver bit is moved from its stored position to be received in said counter bore, it extends orthogonally from said first edge side such that said carrying case functions as a screw driver handle or a handle for the bearing pusher bit;

said carrying case sized with respect to said first elongated tool to seat said first elongated tool within the confines of said carrying case and have all tools stored therein without protruding therefrom when said tools and bits are seated in the respective stored positions;

said first elongated tool being totally separable from the carrying case such that one bit when placed in said counter-bore functions as one tool while the elongated tool simultaneously functions as a second tool with use of the tool bits.

2. A hand tool as defined in claim 1 further comprising:

said seat being in the form of a first groove therealong for receiving said first elongated tool and said first elongated tool being snap fitted within said groove to a stored position.

3. A hand tool as defined in claim 2 further comprising:

said first elongated-tool being a first allen wrench;

a bit receiving hole extending into said carrying case from said groove for receiving a short bit end of said first allen wrench.

4. A hand tool as defined in claim 3 further comprising:

said first edge side having a stepped second narrower groove under the first groove for seating a second smaller diameter allen wrench; and a respective hole extending down from said second smaller groove into said carrying case for receiving a short bit end of said second allen wrench.

5. A hand tool as defined in claim 4 further comprising:

said first groove and stepped second narrower groove each having a lip to form a snap fit with respective first and second allen wrenches.

6. A hand tool as defined in claim 2 further comprising:

said groove having a lip to form a snap fit with the first elongated tool.

7. A hand tool as defined in claim 2 further comprising:

one of said major sides has a recessed notch therein for allowing access to said elongated tool and allowing pulling of said elongated tool from said groove.

8. A hand tool as defined in claim 7 further comprising:

a hexagonal shaped recess in one of the major sides sized to non-rotatably receive a nut;

said recess having an end spaced from the other of said major sides such that said other of said major sides is free from said recess.

9. A hand tool as defined in claim 8 further comprising:

a key ring loop at one edge side and having a hexagonal aperture therethrough differently sized than said recess in said major side to non-rotatably receive a different sized nut.

10. A hand tool as defined in claim 2 further comprising:

a recess in one of said major sides having a seat for seating a pin therein with one end of said pin completely recessed within said hand tool.

11. A hand tools as defined in claim 1 further comprising:

said counterbore extending through one of said edge sides.

12. A hand tool as defined in claim 1 further comprising:

said first elongated tool being an allen wrench; and said allen wrench being embedded in the carrying case;

a bit of said allen wrench extending outward of said carrying case and seatable into a recess in the carrying case when in the stored position and said carrying case being used as a handle for said allen wrench.

13. A hand tool as defined in claim 1 further comprising:

said plurality of recesses extending perpendicular to the edge side that seats said elongated tool.

14. A hand tool as defined in claim 1 further comprising:

said plurality of recesses extending along an edge side opposite to the edge side that seats said first elongated tool.

15. A multiple bit hand tool comprising:

a carrying case having two spaced apart major sides and edge sides therebetween;

a plurality of recesses between said major sides for receiving and storing a plurality of screw driver bits and a bearing pusher therein;

a counter bore in said case along one of said edge sides for non-rotatably receiving a selected one of said plurality of screw driver bits such that when said selected driver bit is moved from its stored position to be received in said counter bore, it extends orthogonally from said edge sides such that said case functions as a screw driver handle or a handle for a tool bit;

said case having a key ring loop extending from an edge side thereof.

* * * * *